US005447457A

United States Patent [19]

Kamitani

[11] Patent Number: 5,447,457

[45] Date of Patent: Sep. 5, 1995

[54] SWIM FIN

[76] Inventor: Shigeki Kamitani, 1-933 Go, 8 Banchi, 1 Chome Nakahara 1, Sogo-Ku, Yokohama, Japan

[21] Appl. No.: 241,924

[22] Filed: May 12, 1994

[51] Int. Cl.[6] ..... A63B 31/11

[52] U.S. Cl. ..... 441/64

[58] Field of Search ..... 441/61-64

[56] References Cited

U.S. PATENT DOCUMENTS 3,068,499 12/1962 Biskupsky ..... 441/63

4,923,419 5/1990 McCarthy ..... 441/64

FOREIGN PATENT DOCUMENTS 89-28272 1/1989 Japan .

2197796 6/1988 United Kingdom ..... 441/64

*Primary Examiner*—Jesus D. Sotelo

[57] ABSTRACT

A swim fin has a footwear made of flexible material to make walking easier and a support which is made of rigid material to provide rigidity. A fin is pivotally coupled to the support so that it can rotate between a locked swim position and a walk position. The support can either be permanently attached to the footwear, or removably coupled to a fitting which is permanently attached to the footwear. Extension devices can be provided so that the swim position can be unlocked from the user's knee, without the user having to bend. The shape of the fin is designed to eliminate overlapping with the other fin when the user is walking.

10 Claims, 8 Drawing Sheets

10
14
26
24
26
22
20
12
3
16
29
31
31
28
30
28

SWIM FIN

FIELD OF THE INVENTION

The present invention is related in general to swimming and diving equipment and in particular to a swim fin.

DESCRIPTION OF RELATED ART

A swim fin (sometimes referred to as a flipper) enhances in-water movement of a swimmer (or a skin-diver) by providing an expanded surface, in form of an artificial fin, extending from the front portion of the swimmer's foot, to increase the effects of the paddle movements of the swimmer's foot. Unfortunately, because the fin of a conventional swim fin is fixedly disposed at the front portion of the foot, it usually makes walking difficult.

In Japanese Kokai number 89-28272, the inventor of the present invention disclosed a swim fin in which the fin can be rotated about a footwear between a swim position (where the fin is at the front of the user's foot) and a walk position (where the fin is at the back of the user's foot) to make it easier for the user to walk. In the swim position, the rotatable fin is secured by a locking mechanism onto the footwear in order to enable paddle movements of the fin in the water. To provide stability of the fin (i.e., so that the fin will not wobble) while paddling in the water and to be able to securely lock the fin in the swim position, the bottom portion of the footwear according to that invention is made of rigid material. Unfortunately, because the bottom portion of the footwear is rigid, it is usually difficult for the user, while wearing the swim fin, to walk on land and underwater, as the rigid bottom of the footwear would slip over stones, sand, pebbles and the like.

SUMMARY OF THE INVENTION

The present invention provides an improved swim fin in which the fin can be rotated between a swim position (where the fin is at the front of the foot) and a walk position (where the fin is at the back of the foot). However, the swim fin according to the present invention has a footwear which is made of a flexible material to facilitate walking. To provide the necessary rigidity, a rigid support is affixed to the footwear. The fin is then coupled to the rigid support to be rotatable between the swim position and the walk position.

In another aspect, the present invention provides an improved swim fin which includes a shoe-like footwear. The footwear has a base on the top thereof. The swim fin has a rigid frame which is removably coupled to the base. The fin is mounted to the frame and can be rotatable about the footwear between a swim position wherein the fin is in front of the foot and a walk position wherein the fin is at the back of the foot.

In another aspect, the present invention also provides an improved swim fin in which the fin is rotatable between a swim position and a walk position. The swim fin also has a lock for locking the fin in the swim position. According to this aspect of the invention, the improved swim fin also has an extension means for releasing the lock from a point above the foot, so that the fin can be changed from the swim position into the walk position without a user having to bend his/her body.

In another aspect, the present invention also provides an improved swim fin in which the fin can be rotated between a swim position and a walk position. The fin according to this aspect of the invention is configured to prevent overlapping with the other fin being worn by the user when both of the swim fins worn by the user are in the walk position.

DESCRIPTION OF THE EMBODIMENTS

The present invention provides an improved swim fin which allows a user to walk easier while wearing the swim fin.

Figure 1A:
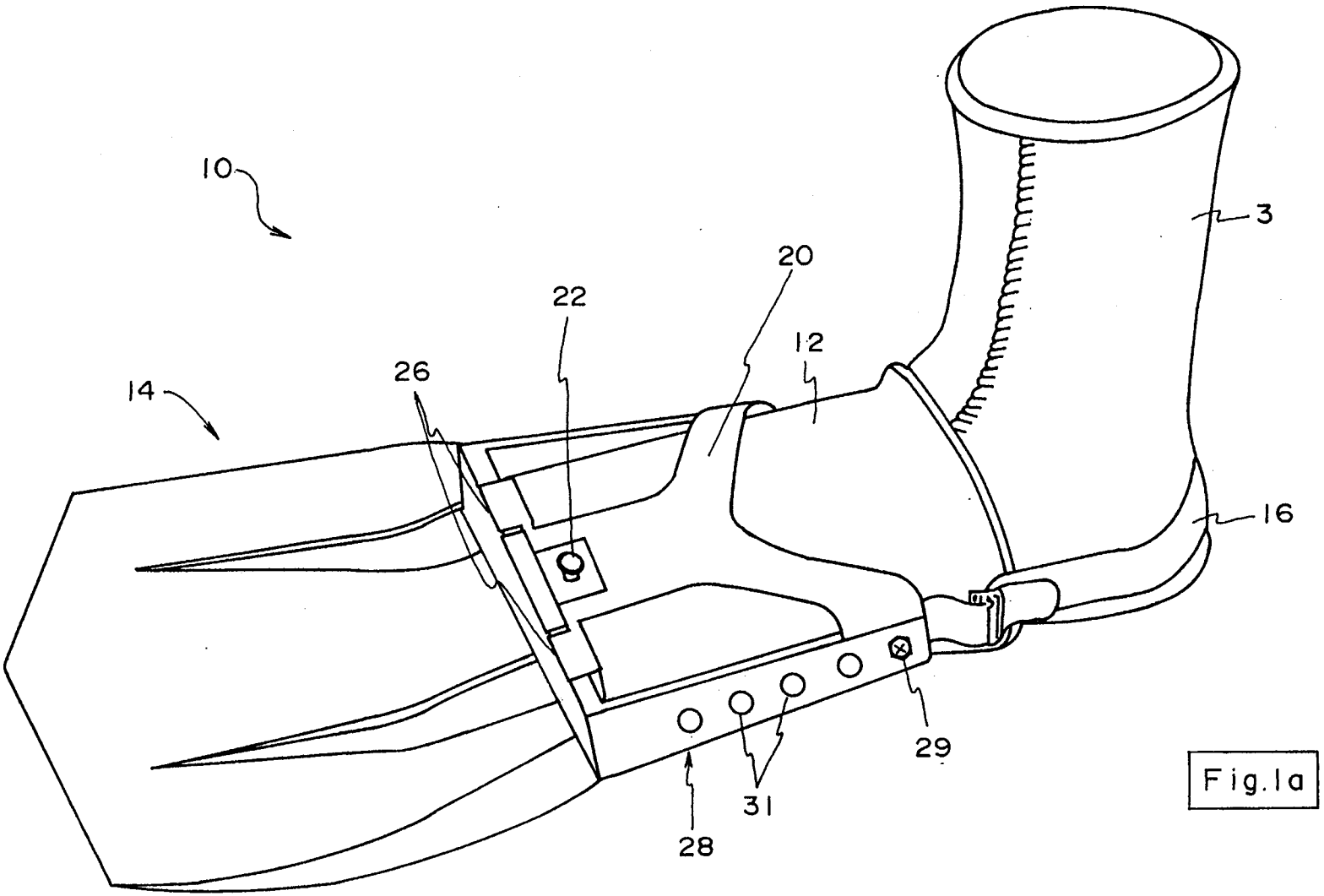
FIG. 1*a* depicts a swim fin with a rotatable fin, a footwear and means for providing rigidity to enable the footwear to be made with flexible material.

FIG. 1*a* is a drawing of a swim fin 10 having a footwear 12 and a rotatable fin 14. Footwear 12 can be a slip-on cover with an adjustable strap 16 for adaptively securing the footwear 12 to a user's foot. Alternatively, footwear 12 can also have the shape of a shoe, sock, or marine boot 13 as shown in FIG. 1*d*.

Footwear 12 is made of a non-rigid material, such as an elastomer or rubber or a combination thereof, so as to make it less slippery and therefore easier for a user to walk over stones, pebbles, rocks and the like that are commonly found in the use environment of the swim fin 10, such as on a beach or underwater terrain. While it is desirable to have the footwear 12 (or 13) made of a nonrigid material, the footwear 12 and 13 must, however, have certain rigidity to ensure that the fin 14 can be securely locked onto the footwear 12 in the swim position, and that the fin 14 will not wobble laterally during paddle movements of the fin 14.

In accordance with the present invention, such rigidity is provided by a support 20 on the top of footwear 12, which is made of rigid material such as hardened or reinforced rubber or plastic, either integrally molded with the footwear 12 or attached to the footwear 12. Alternatively, rigidity of the footwear 12 can be provided by a support which is made of metal (e.g., aluminum) and attached to the footwear 12 by, for example, a bolt or rivet.

According to one embodiment of the present invention, support 20 is a generally Y-shaped frame which extends from the two sides of the footwear 12 to the front of footwear 12 and is affixed to the footwear 12 by bolts or rivets 29. A plurality of holes 31 can optionally be made on the frame 20 to reduce the total weight of the swim fin 10.

Figure 5:
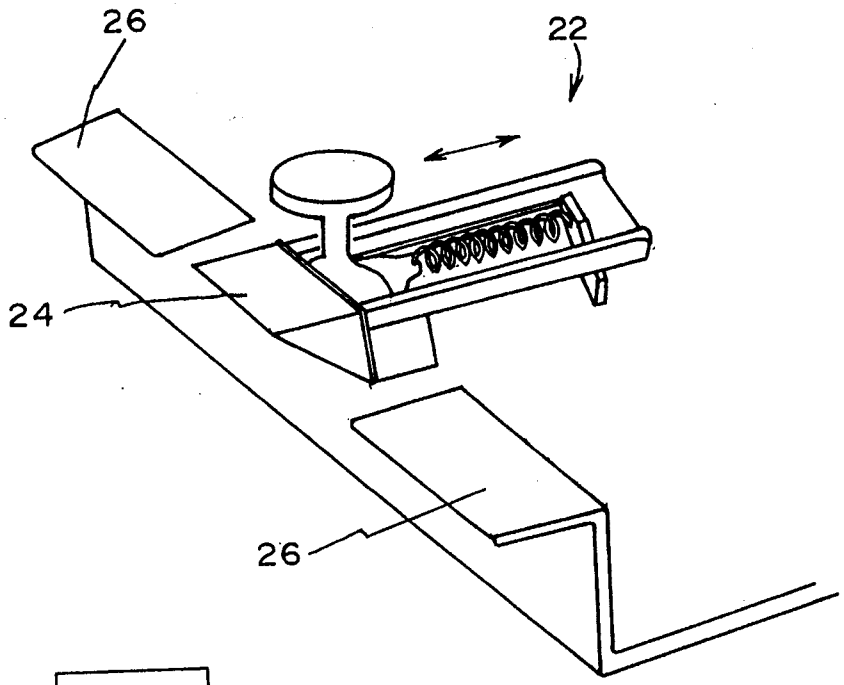
FIG. 5 is an isometric view of the lock used to lock the rotatable fin to the footwear in the swim position.

At the front of the support 20 is a lock 22, such as a spring-urged bar 24 with a knob as shown in FIG. 5. The bar 24 can be removably inserted into a hole 30 (see FIG. 1*b*) in the rotatable fin 14 to thereby lock the rotatable fin 14 to the footwear 12 in the swim position.

Figure 1B:
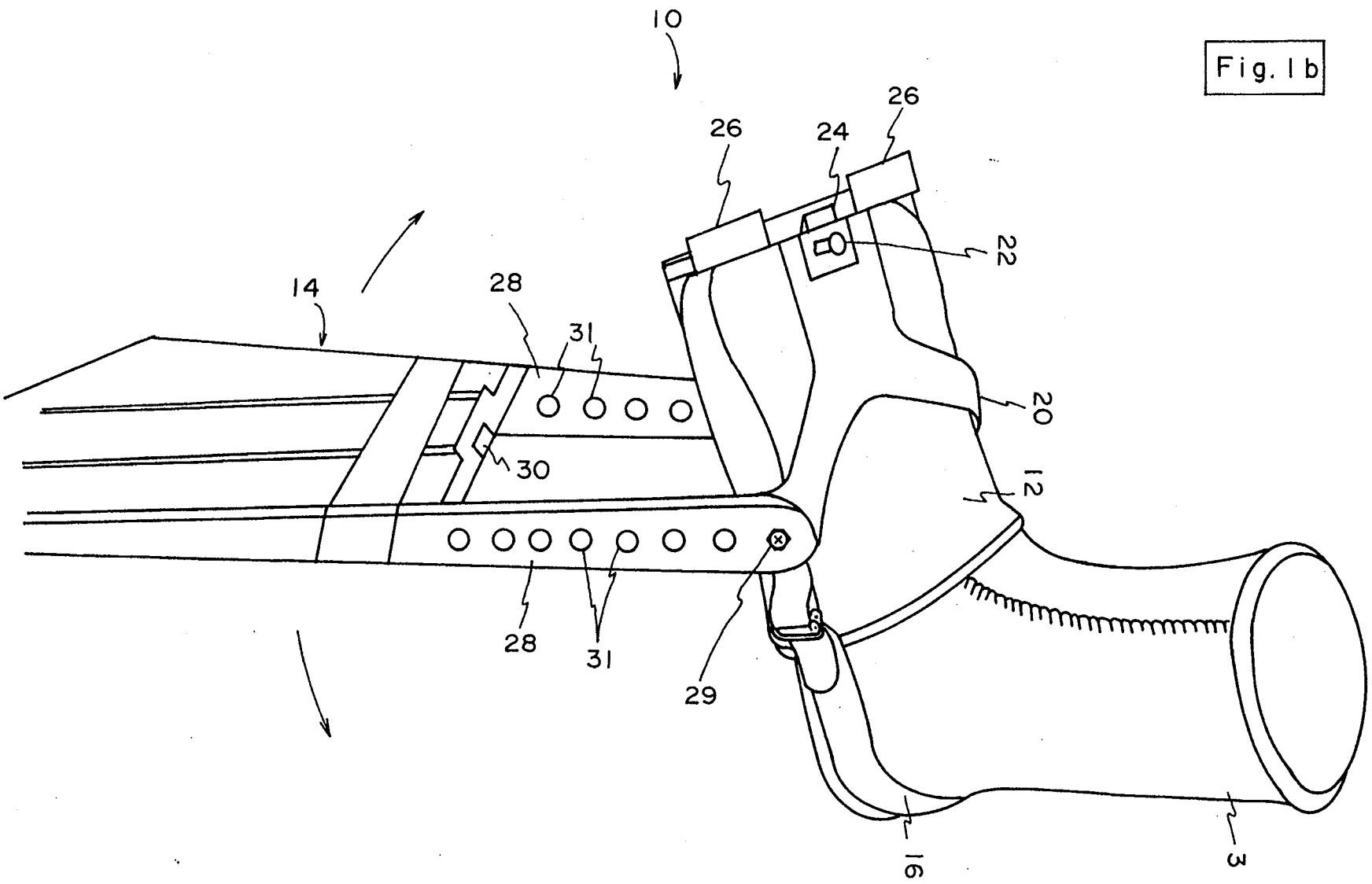
FIG. 1*b* is a diagram of the swim fin of FIG. 1*a* showing how the fin changes from the walk position to the swim position and vice versa.
Figure 1C:
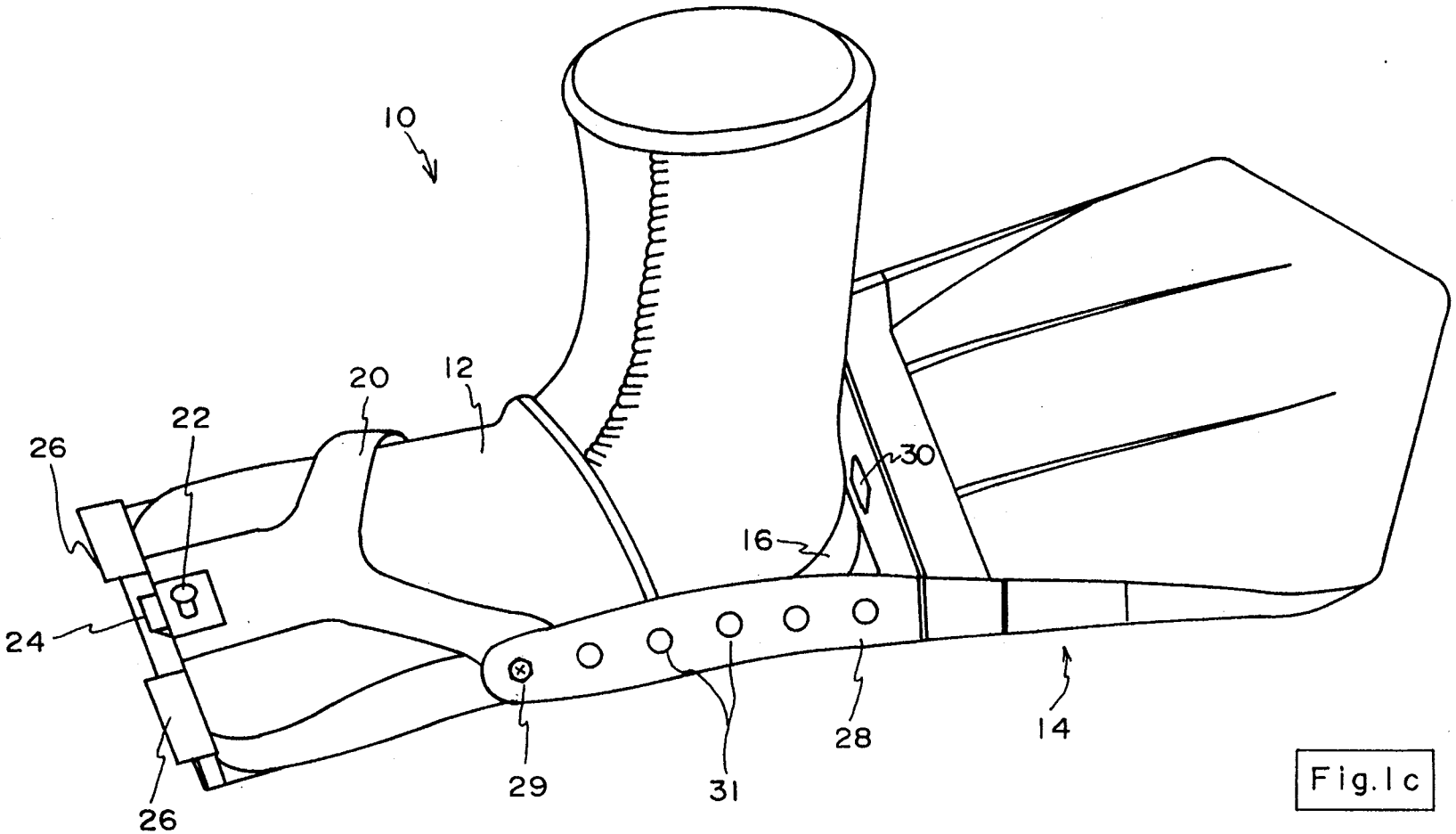
FIG. 1*c* shows the swim fin of FIG. 1*a* with the fin in the walk position.
Figure 1D:
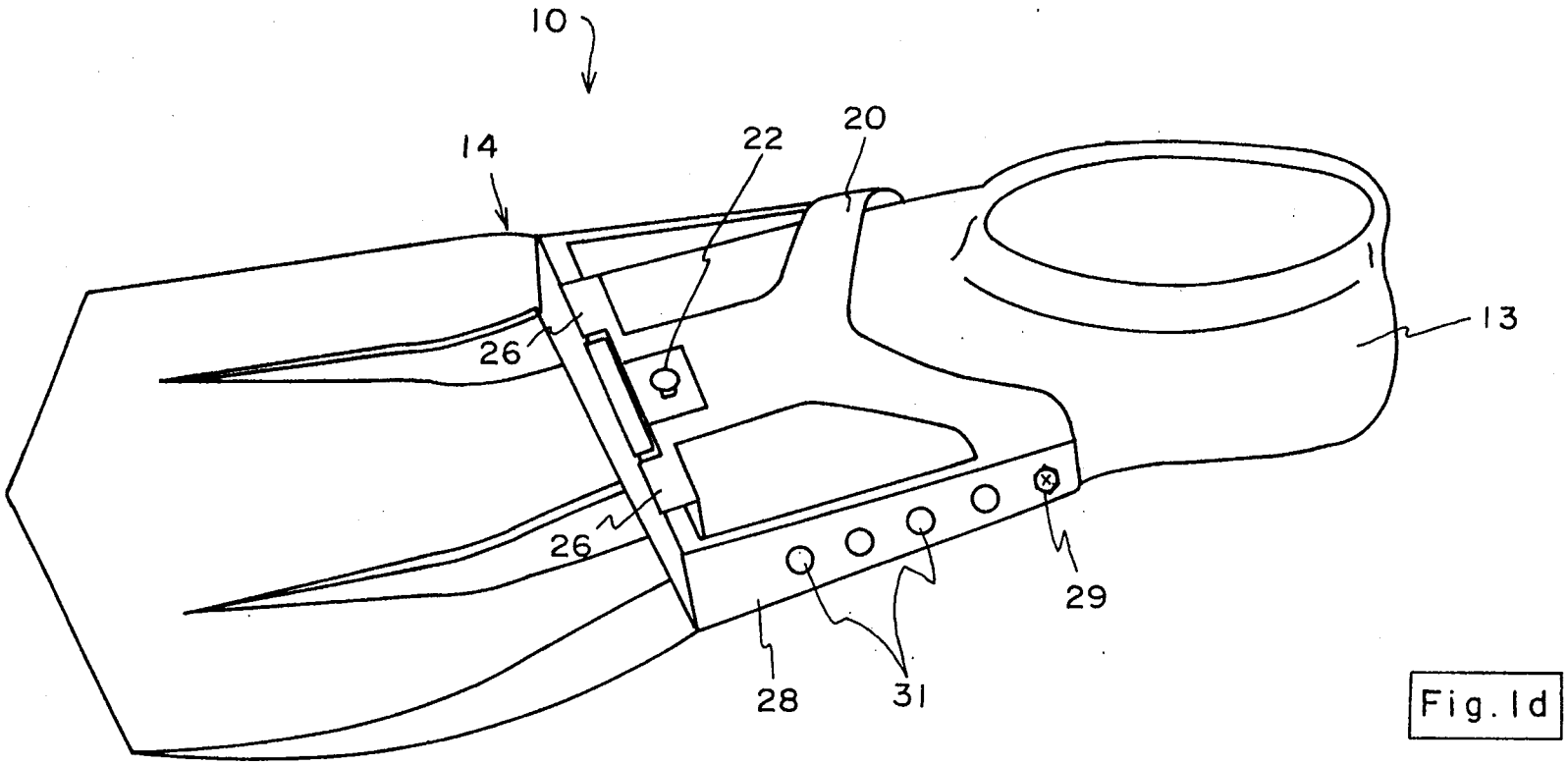
FIG. 1*d* shows the swim fin of FIG. 1*a* with a different type of footwear.

The rotatable fin 14 can be rotated between a swim position as shown in FIG. 1*a*, around the bottom of the footwear 12 as shown in FIG. 1*b*, into a walk position as shown in FIG. 1*c*, and vice versa. In the walk position, the rotatable fin 14 is located behind the user's foot and therefore will not interfere with forward movement of the user. When the user enters the water and begins to swim, the toes of the user will point horizontally to the back, but movement of the rotatable fin 14 is restrained by resistance of the water. As a result, the rotatable fin 14 will automatically rotate around the footwear 12 and become aligned with the front portion of the foot. A pair of protrusions 26 are provided on the front edge of the frame 20 to stop the rotation of the rotatable fin 14 when the fin 14 is aligned with the footwear 12. When the rotatable fin 14 is aligned with the front portion of the footwear 12, the lock 22 at the front edge of the footwear 12 will automatically engage the hole 30 on the rotatable fin 14 and thereby lock the rotatable fin 14 in the swim position.

Rotatable fin 14 is mounted onto a generally U-shape frame 28. The frame 28 is made of a rigid material such as metals (e.g., aluminum), or hardened or reinforced rubber or plastic. The flanges of the frame 28 can be tapered from the footwear end towards the fin end to increase the strength thereof. To reduce the weight of swim fins 10, a plurality of holes 31 can optionally be made on the frame 28. The two flanges of the frame 28 are rotatably coupled to the support 20 by attaching means 29 such as bolts or hinges.

When fin 14 rotates from the walk position to the swim position, as when the user enters the water, the rotatable fin 14 will automatically rotate to the swim position as described above, and the spring-urged bar 24 (see FIG. 1*b*) of the lock 22 will automatically slide into the hole 30 in the U-shaped frame 28, thereby automatically locking the swim fin 14 into a swim position as shown in FIG. 1*a*. To accommodate different size of footwear 12, the holes 31 can be made to be able to receive the attaching means 29, so that distance between the frame 28 and the footwear 12 can be adjusted. However, the distance of the lock 22 from the frame 20 must then be also adjustable. Adjustment of such distance can be provided by mounting the lock 22 on a plate (not shown) which in turn is adjustably mounted on the frame 20, such as by providing a plurality of holes for receiving a bolt which passes through a threaded hole on the frame 20.

Figure 2A:
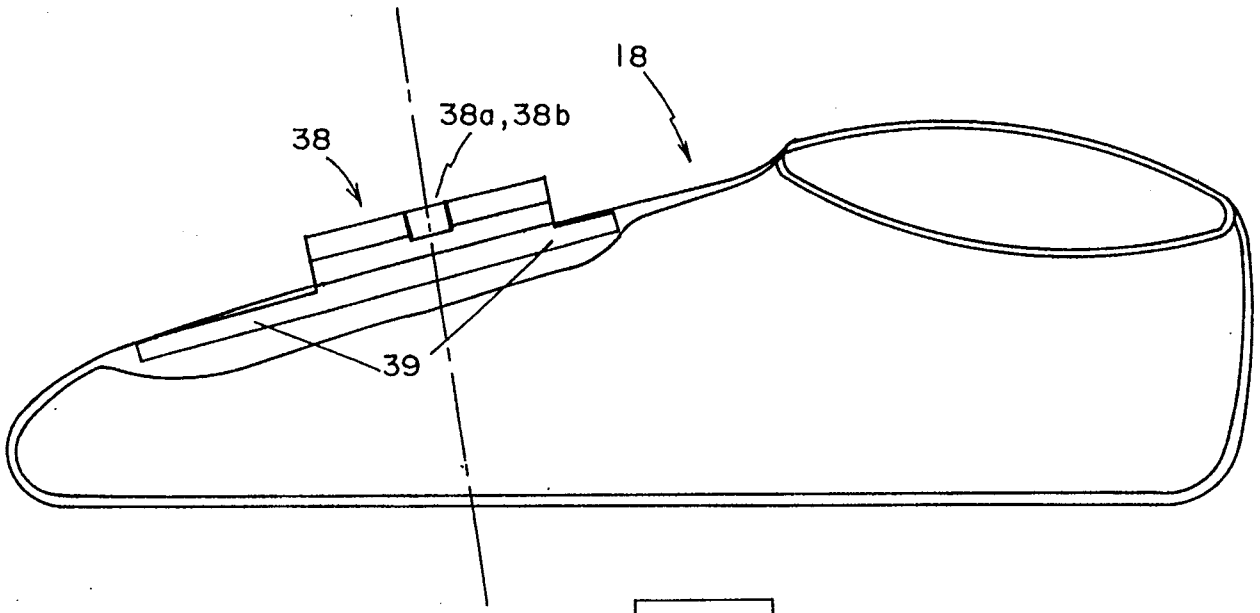
FIG. 2*a* shows a shoe-like footwear having a fitting for removably coupling a rotatable fin in accordance with another embodiment of the present invention.
Figure 2B:
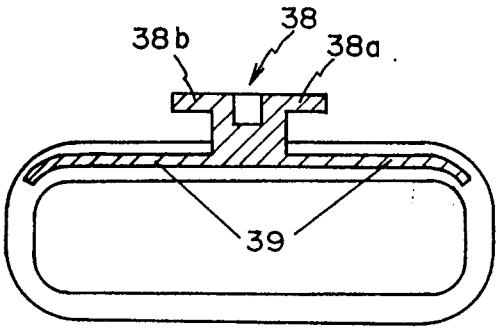
FIG. 2*b* is a sectional drawing of the footwear and the fitting of FIG. 2*a;*

FIG. 2, which comprises FIGS. 2*a*, 2*b*, 2*c*, 2*d* and 2*e*, shows an alternative embodiment of the present invention. The rotatable swim fin 40 in the embodiment shown in FIG. 2 is removably coupled to footwear 18, which can be a shoe, a marine boot, an aqua-sock or a diving footgear, as shown in FIG. 2*a*, made of rubber and/or other material typically used for making swim wear or diving gear. A sectional view of the footwear 18 is shown in FIG. 2*b*. The footwear 18 has a fitting 38, such as a metal plate with flanges 38*a* and 38*b* and a base 39, on top of the footwear 18. The fitting 38 can be made of hardened rubber or metal such as aluminum either integrally molded with or attached to the shoe 18. On the top of the fitting 38 is a threaded hole 38*c* for receiving a screw.

Figure 2C:
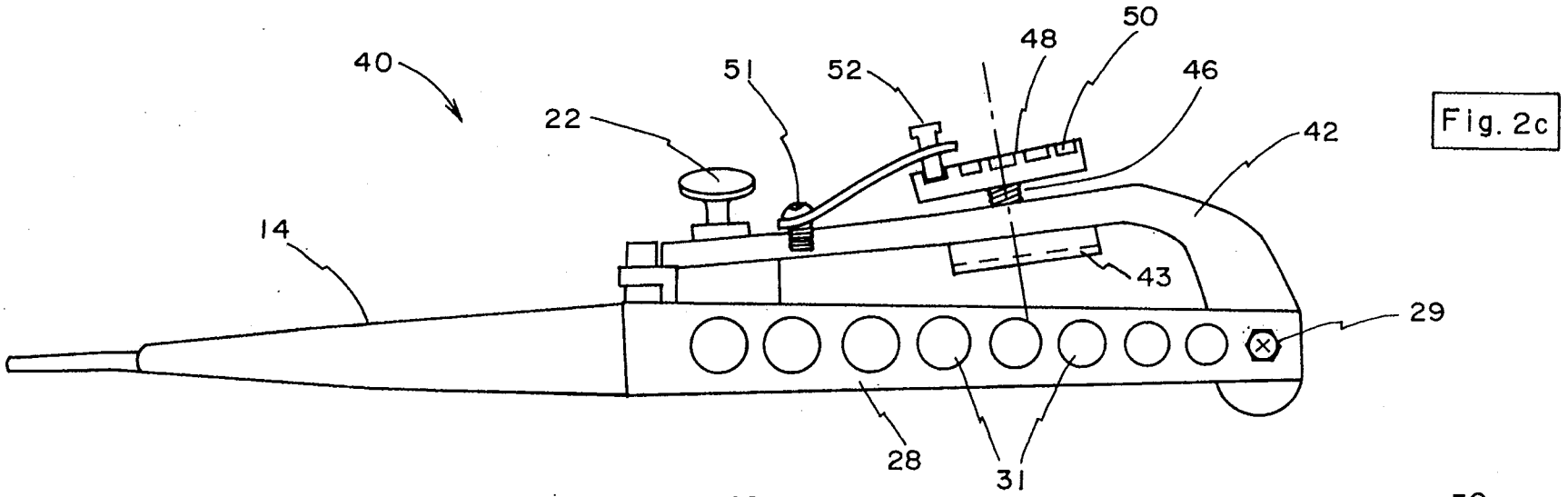
FIG. 2*c* is a drawing of a rotatable swim fin assembly which can be removably coupled to the footwear of FIG. 2*a;*

As shown in FIG. 2*c*, the rotatable fin 40 according to this embodiment has a structure substantially similar to the structure shown in FIG. 1 (i.e., with a fin and an inverted U-shape frame 42) but without the footwear 12 of FIG. 1. The rotatable fin 40 has an inverted U-shape frame 42 having a coupler 43 which can be slid into the fitting 38 on the footwear 18 as shown in FIG. 2*a*. When coupled, the flanges 43*a* and 43*b* of the coupler 43 (see FIG. 2*d*) will be held by flanges 38*a* and 38*b* of the fitting 38. A securing means, such as a screw 46, is provided for securing the frame 42 to the fitting 38.

Figure 2E:
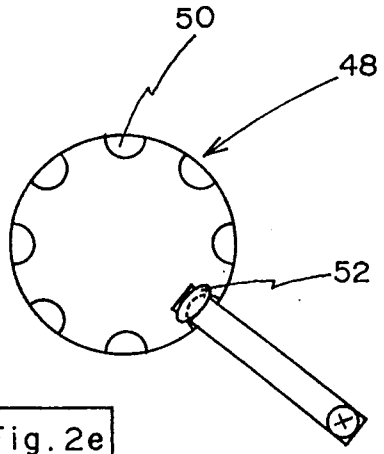
FIG. 2*e* is a top view of the locking mechanism for securing the lock of the rotatable fin of FIG. 2*c;*
Figure 2D:
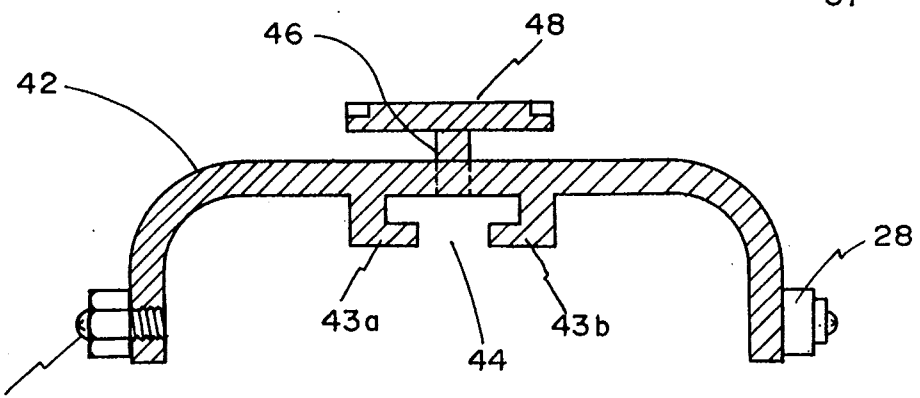
FIG. 2*d* is a sectional drawing of the rotatable swim fin assembly of FIG. 2*c;*

In order to prevent unintentional loosening of the screw 46, a plurality of receptacles 50, as shown in FIGS. 2*c* and 2*e*, are preferably provided on top of the screw 46. On the frame 42 is mounted a restraining means, such as a hammer 52. The hammer 52 can be mounted by, for example, one or more bolt or a rivet 51. The hammer 52 is adapted to engage one of the receptacles 50 on the knob 48. When the hammer 52 engages a receptacle 50, securing screw 46 is prevented from unintentional rotational movement.

Figure 3:
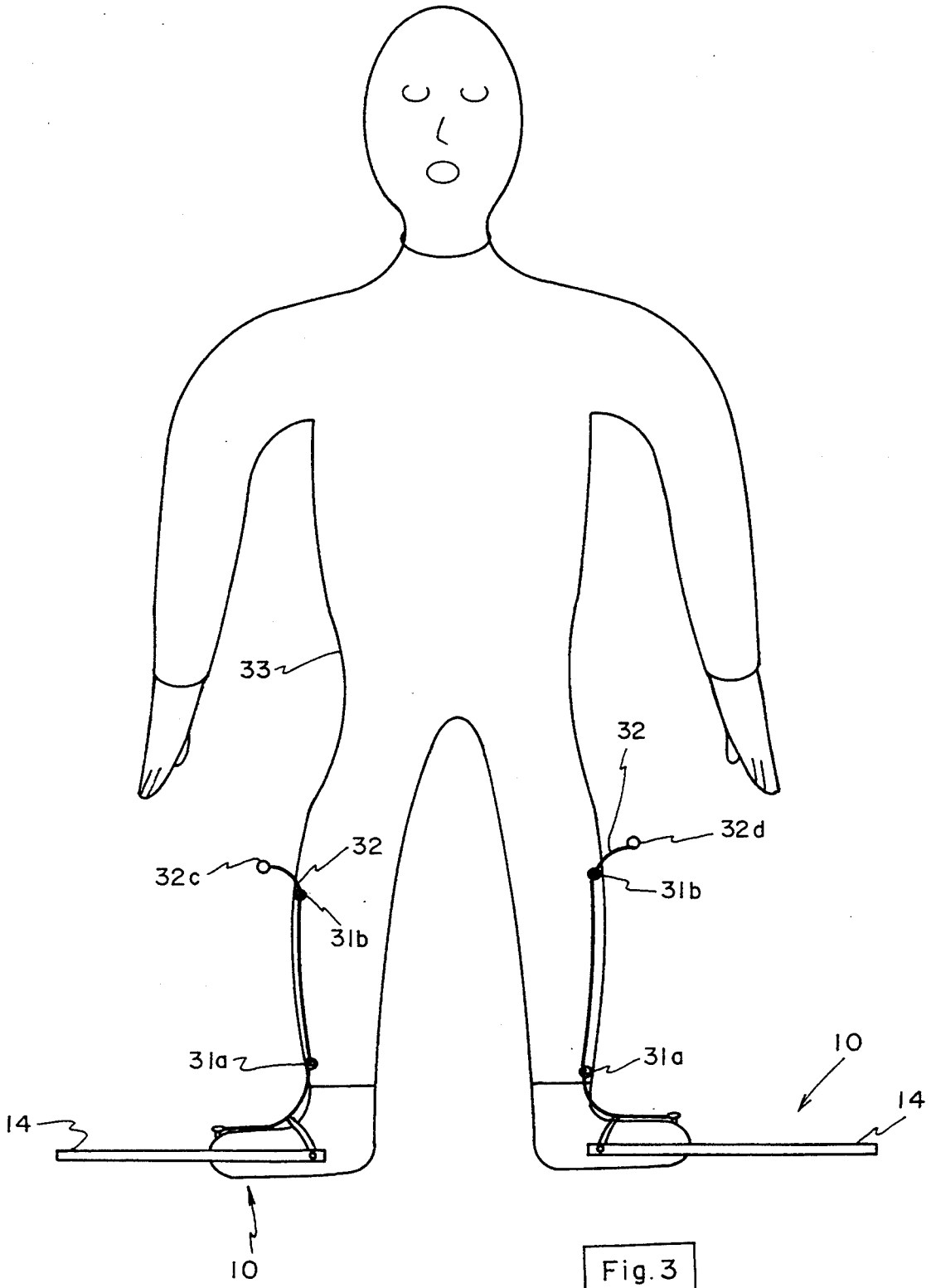
FIG. 3 is a drawing showing an extension means for enabling unlocking, from the knee, of the rotatable swim fins such as those shown in FIGS. 1*a* and 1*d;*

As described, the rotatable fin 14 in the above described embodiments will automatically change from the walk position to the swim position when the user enters into the water and begins to swim. At the swim position, the fin 14 is locked onto the footwear 12 or 18 by the lock 22. When the user returns to land, the lock 22 must be released to allow the rotatable fin 14 to rotate back to the back of the foot. Referring to FIGS. 3*a* and 3*b*, to facilitate release of the lock 22 so as to allow the fin 14 to change to a walk position, an extension means 32, such as a wire, string or rope, can be tied to the lock 22. If the user is wearing a diving or swimming gear 33, the rope 32 can be made to pass into the interior of the swim gear 33 from a hole 31*a* and exits from an upper hole 31*b* on the swim gear 33. A knot or knob 37*c*, 37*d*, is provided on the upper end of each rope 32 to make it easier for the user to pull the rope 32. If the user is not wearing a diving gear, a elastic band (not shown) can be provided near the knee of the user (or somewhere between the ankle and the hip) and the rope 32 can then be held by the elastic band. By pulling the rope 32, the lock 22 can be conveniently released. When the lock 22 is released, rotatable fin 14 can be rotated to the back of the foot as the user lifts his/her foot to take the first step on the land.

Figure 4:
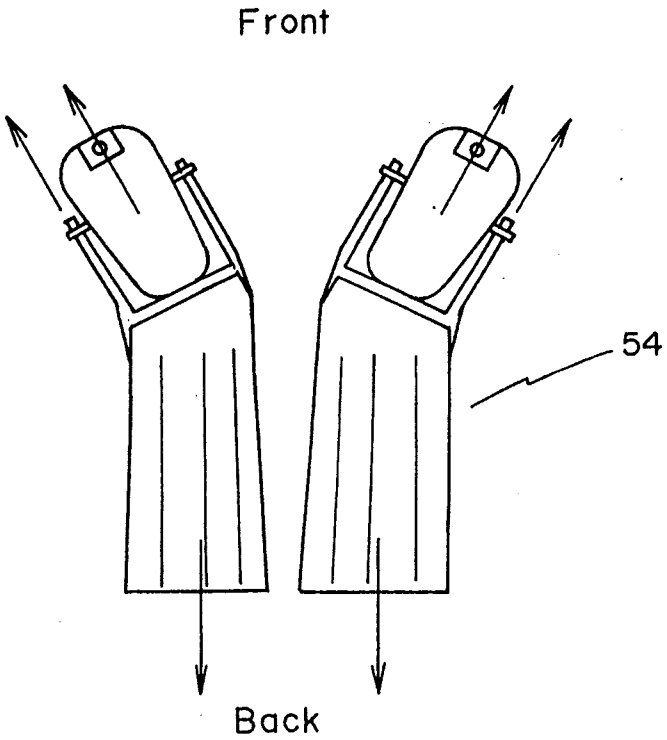
FIG. 4 is a drawing showing a pair of rotatable swim fins wherein each fin is configured to prevent overlapping with the other fin being worn by the user to further facilitate walking.

To increase the paddle effect of the swim fin, the fin typically broadens laterally as the fin extends from the feet. As a result, the fins 14 will usually overlap each other while the user is walking, even when the fins 14 are rotated to the back of the feet, especially for those users who walk with the toes pointing slightly outward to the side. To further facilitate walking, the fin is either cut, or each swim fin 54 is angled obliquely outward, with the result that the fin will not overlap one other, even if the feet of the user are pointing outward, as shown in FIG. 4.

While the present invention is described with reference to the preferred embodiments, it will be understood that numerous modifications and additions can be made to the described embodiments without departing from the spirit of the invention which is defined by the following claims:

What is claimed is:

1. A swim fin, comprising:

a footwear having a flexible bottom;

a rigid support on said footwear;

a fin coupled to said support and rotatable between a swim position where the fin is at the front of a foot, and a walk position where the fin is at the back of the foot;

wherein said rigid support comprises a fitting permanently affixed to said footwear and wherein said fin is mounted on a frame which is removably coupled to said fitting; and wherein said frame comprises a screw for coupling to a threaded hole in said fitting.

2. A swim fin as in claim 1, further comprising restraining means mounted on said frame for restraining rotational movement of the screw.

3. A swim fin, comprising:

a footwear having a flexible bottom;

a rigid support on said footwear;

a fin coupled to said support and rotatable between a swim position where the fin is at the front of a foot, and a walk position where the fin is at the back of the foot;

a locking means for locking the fin in said swim position; and an extension means for releasing the lock means from a position above the foot.

4. A swim fin in claim 3, wherein said extension means comprises a string having one end tied to said locking means.

5. A swim fin, comprising:

a rigid frame;

a fin pivotally mounted to the frame and rotatable between a swim position and a walk position; and coupling means affixed to the frame for coupling the frame to a footwear, comprising a screw for coupling to a threaded hole in a fitting on said footwear.

6. A swim fin as in claim 5, further comprising restraining means for restraining rotational movement of the screw.

7. A swim fin, comprising:

a rigid frame;

a fin pivotally mounted to the frame and rotatable between a swim position and a walk position; and means affixed to the frame for coupling the frame to a footwear;

means for locking the fin in said swim position; and an extension means for releasing the lock means from a position above the foot.

8. A swim fin as in claim 7, wherein said extension means comprises a string having one end tied to said locking means.

9. A swim fin, comprising:

a footwear;

a fin coupled to said footwear and rotatable between a swim position where the fin is at the front of a foot and a walk position where the fin is at the back of the foot;

means for locking the fin in said swim position;

extension means for releasing the lock means from a position above the foot; and wherein the fin is configured to angle obliquely outward in said walk position to prevent the fin from overlapping with another fin being worn by a user.

10. A swim fin as in claim 9, wherein said footwear has a flexible bottom.

* * * * *